US005447289A

United States Patent [19]

Callahan

[11] Patent Number: 5,447,289

[45] Date of Patent: Sep. 5, 1995

[54] PRY SHOVEL TOOL FOR WOODEN PALLET DECK BOARD REMOVAL

[76] Inventor: Eugene J. Callahan, 9519 Marigold La., Munster, Ind. 46321

[21] Appl. No.: 298,051

[22] Filed: Aug. 29, 1994

[51] Int. Cl.[6] ..... B66F 3/00

[52] U.S. Cl. ..... 254/131; 254/25

[58] Field of Search ..... 254/15, 17, 25, 131, 254/131 A, 134, DIG. 3; 294/57, 58, 167; 16/110 R, 114 R, 114 A, 115

[56] References Cited

U.S. PATENT DOCUMENTS

| | | | |
|---|---|---|---|
| 1,309,734 | 7/1919 | Hemfling | 254/25 |
| 1,343,862 | 6/1920 | Williams . | |
| 1,375,751 | 4/1921 | Grannis | 254/25 |
| 1,514,060 | 11/1924 | McCallum . | |
| 1,892,824 | 1/1933 | Ziegler et al. | 29/267 |
| 2,565,466 | 8/1951 | Barker | 294/57 |
| 2,929,609 | 3/1960 | Graef | 254/131 |
| 3,049,337 | 8/1962 | Griggs | 254/131 |
| 3,069,139 | 12/1962 | Charbonneau . | |
| 3,113,758 | 12/1963 | Knowles . | |
| 4,086,699 | 5/1978 | Olkkola . | |
| 4,198,090 | 4/1980 | Gutman | 294/58 |
| 4,203,210 | 5/1980 | Hadlick, Jr. . | |
| 4,538,847 | 9/1985 | Lapshansky | 294/57 |
| 4,745,651 | 5/1988 | Schellenger | 254/131.5 |
| 4,809,436 | 3/1989 | Crookston . | |
| 5,165,659 | 11/1992 | L'Heureux | 254/131 |
| 5,176,363 | 1/1993 | Bowlin | 254/131 |

*Primary Examiner*—Robert C. Watson
*Attorney, Agent, or Firm*—Richard G. Kinney

[57] ABSTRACT

A pry shovel tool for wooden pallet deck board removal and similar purposes is disclosed in several embodiments. All embodiments include a general S-shaped (in cross-section), relatively thin blade made of thin spring metal, whose forward section defines a central cut-out portion sized to allow the blade to receive therein the cross member of the pallet or like and, for the sections of the blade adjoining the cut-out to penetrate below the board to be removed. In one employment, a permanent elongated handle is affixed to the rear portion of the blade. In a second embodiment, a wider blade and cut-out are provided to accommodate wider pallet cross members such as a 4×4 timber. A third embodiment has a blade equipped with means for manually attaching removable handles with a short-length handle, an elongated straight handle, and a handle with a 90 degree removable extension section being disclosed.

16 Claims, 4 Drawing Sheets

PRY SHOVEL TOOL FOR WOODEN PALLET DECK BOARD REMOVAL

FIELD OF THE INVENTION

The present invention relates to tools for use in removing surface boards from wooden pallets.

BACKGROUND OF THE INVENTION

The wood commonly used in pallets and skids is prone to split and is commonly fastened by fasteners which are very hard to pull out. The deck boards are usually spaced apart by about ¼ to 2 inches, allowing room for a pry bar to be inserted between them and to be used to pry off a deck board from the cross members. Conventional pry bars damage the boards and often split them.

Roof shingle-removing tools, such as those disclosed in U.S. Pat. Nos. 4,809,436; 4,086,699; 4,203,210, including shovels used as pries as in U.S. Pat. No. 3,113,758, are of little use in trying to raise the tighter-held, thicker surface boards of a wooden pallet. Roof board and floor board removers, such as shown in U.S. Pat. Nos. 5,176,363; 3,039,337; 1,343,862; and 5,165,659, require side access to work. For example, the tools of the U.S. Pat. Nos. 3,049,337 and 3,069,139 references require an opening to be first made to provide access to a rafter and so that the operational ends of their tools can be positioned under the boards to be lifted. The U.S. Pat. No. 5,165,659 patent described rigid sharp-edged, relatively thick tines which can be used as a wedge to break through a roof and suggests use by a fireman to do so. Such rigid tools like the conventional crow bars tend to split the brittle wood boards of a pallet or are unable or difficult to be used to "start" pallet board removal at all.

Thus, despite such prior suggestions in the art, there exists the need for a tool which can be used to remove the surface boards of a wooden pallet without removing a first board (to provide access to a cross member) and which does not split or dent an adjacent surface board and which helps to lift a surface board without splitting it.

SUMMARY OF THE INVENTION

In accordance with the present invention, a pry shovel is provided with a relatively thin but wide blade made of relatively thin resilient or spring metal, less than ¼ inch and preferably about 3/32 inch in thickness. This thin blade can be inserted between the pallet deck boards and is so formed as to provide a central notch or cut-out from its forward edge rearward, which cut-out is sized to receive the pallet cross member and which allows the blade to pass on either side of the cross member which is received in the cut-out. The blade is preferably curved in its cross section so as to provide a fulcrum shoulder for contacting an adjacent deck board while the forward edge and adjacent surfaces contact the bottom of the board to be removed with the area of contact extending for a distance on either side of the cross member. A handle flexes the blade and applies an upward lifting force to the surface board.

The invention, together with further advantages and features thereof, may best be understood by reference to the following description, taken in connection with the accompanying drawings, in the several figures of which like reference numerals identify like elements.

DETAILED DESCRIPTION OF THE PREFERRED EMBODIMENTS

Figure 1:
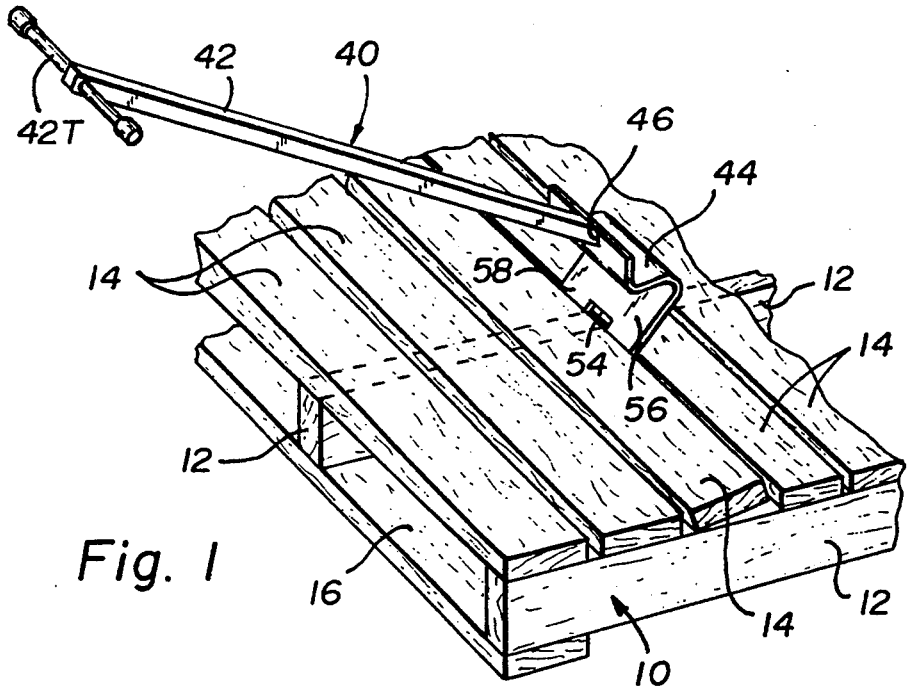
FIG. 1 is a perspective view of a wooden pallet with pry shovel constructed in accordance with the principles of the present invention shown being positioned for use.

Referring to FIG. 1, a conventional wooden pallet is there shown and generally identified by the number 10. The pallet 10 has cross members 12 onto which deck or surface boards 14 are nailed across its upper surface. Similar surface or deck boards 16 are nailed to the bottom of the cross members 12 to form the underside of the pallet 10.

A pry shovel 40 constructed in accordance with the principles of the present invention is also depicted in FIG. 1. The pry shovel 40 has a handle 42 and a blade portion 44. The elongated handle may be of any suitable strong material such as a rectilinear tube of about 1/16 inch thick common steel. It should be of a length so as to provide sufficient leverage for lifting a board 14 and defeating the hold of the strong fasteners conventionally used in wooden pallets. A handle 42 of about 31 inches in length and a cross-sectional size of about ½×1½ inches is preferred, although these dimensions can be varied over a wide range, and other types of handles employed without departing from the principles of the present invention. The handle 42 preferably has a cross member 42T near its top to provide for ease of gripping.

Figure 2:
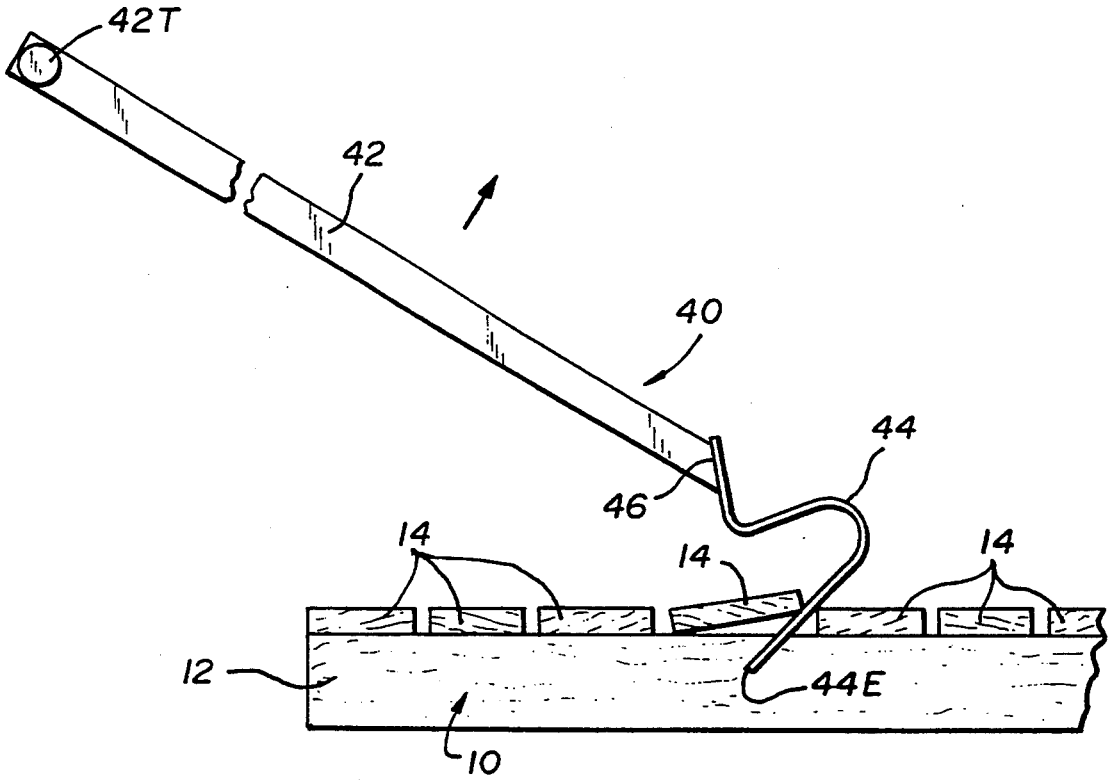
FIG. 2 is a side view of the pry shovel of FIG. 1 in use in removing a surface board from a pallet which pallet is shown in fragmentary and partly sectional view and a portion of the pry shovel handle being shown broken and shortened for convenience in depiction.
Figure 3:
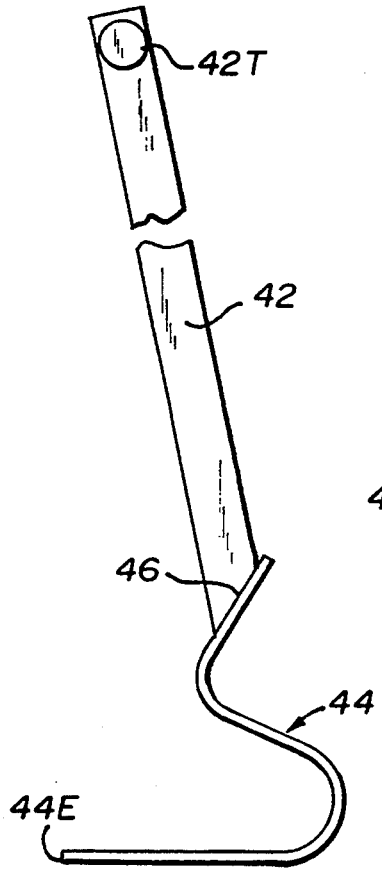
FIG. 3 is a side or elevational view of the pry shovel of FIGS. 1 and 2 with the handle portion shown broken and shortened for convenience in depiction.
Figure 4:
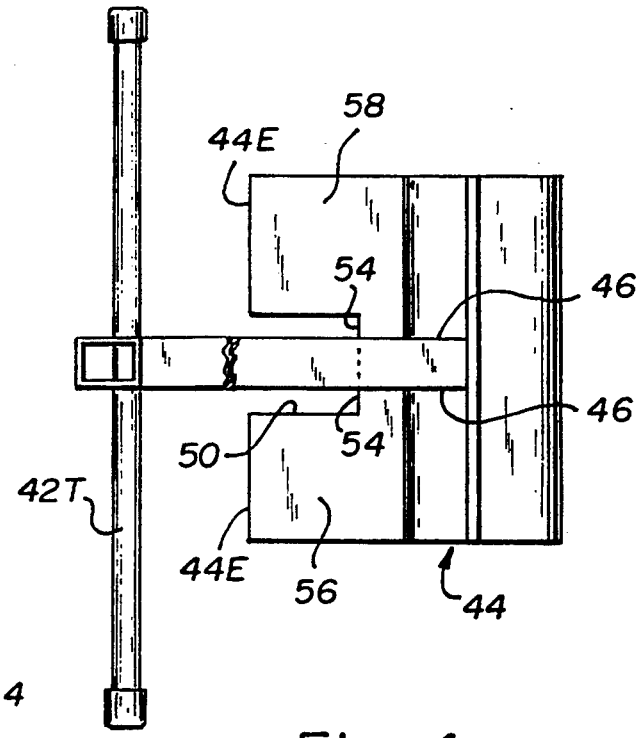
FIG. 4 is a top view of the blade and a broken and shortened handle of the pry shovel of FIG. 3.

The blade 44 is formed of uniformly thin spring metal having one portion of the handle 42 welded at 46 to its rear end and, as better shown in FIG. 3, is curved (in cross section) into a general S shape below the junction 46 before running flat so as to lie in one plane to its forward edge 44E. As shown best in FIG. 4, the blade 44 defines a large rectilinear central notch or cut-out 50 which runs rearward from the edge 44E to a recessed edge 54 which is parallel to the front edge 44E. The notch or cut-out 50 is centrally located so that on either side of it are two approximately equal rectangular areas 56, 58. The width of the cut-out 50 is sized to loosely receive the cross member 12 so that the blade 44 can be placed as shown in FIGS. 1 and 2, with the areas 56, 58 on either side of a cross member 12. With this arrangement, the upper surfaces of the areas 56, 58 can bear against the underside of a board 14 and, by pivotally displacing the handle 42 as shown by the arrow in FIG. 2, lifting pressure is applied to the board 14.

As best seen in FIG. 3, the pry shovel 40 when at rest and not under stress has its forward portion of the blade 44 in a flat plane and its handle 42 is at an approximately 80 degree minimal angle to that plane.

The embodiment of FIGS. 1 through 4 of the present invention is designed for pallets using 2×4 or 2×6 conventionally sized lumber for the cross member 12. A preferred size to this pry shovel is approximately 35½ inches in overall length with the cross T member being about ¾ inch in diameter by about 11½ inches in overall length. The blade of this example has a cut-out 50 of about 1¾ inch wide by about 1¾ inch deep and edges 44E of about 2¼ inches each in length to provide an overall width of the blade of about 6 inches. The curving blade portion 44S preferably has a 2-inch diameter curve. The length of the blade below the handle attachment 46 is preferably about 9½ inches and the handle-receiving section is preferably about 2 inches. The unfolded overall size of the blade 44 is thus about 6×10½ inches. Twelve gauge No. 1075 spring steel tempered to 44 Rockwell hardening is presently preferred for the blade 44. The handle is preferably made from 16 gauge steel.

Figure 5:
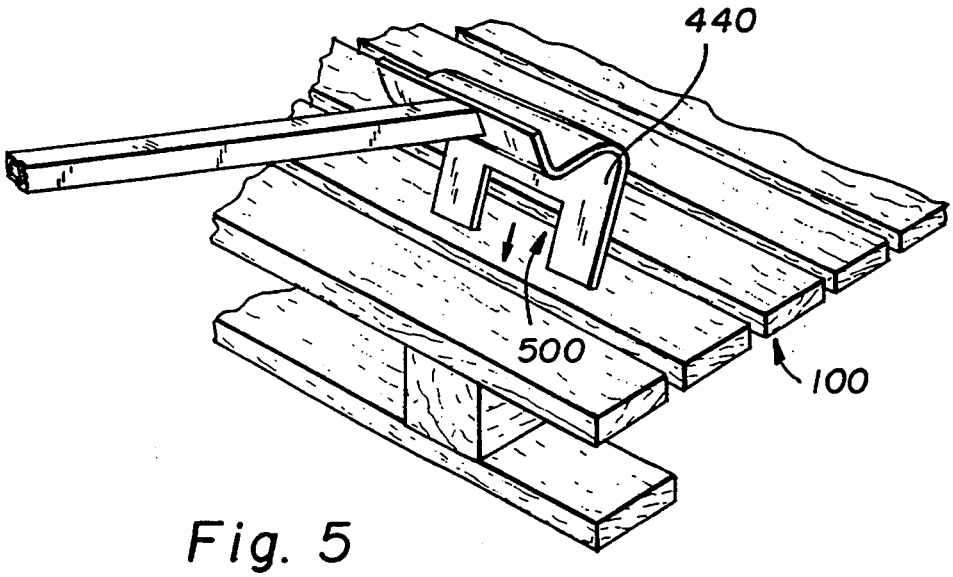
FIG. 5 is a perspective view of a portion of a different pallet from that shown in FIG. 1 and of a second embodiment of the inventive pry shovel shown prior to insertion into this pallet. The end of the pry shovel handle is shown broken away for ease of depiction.

A second embodiment 60 is shown in FIG. 5 for use with a different pallet 100. This pallet 100 uses wider cross members 120, usually a 4×4 (normal 4-inch square). The pry shovel 60 is constructed similarly to that of the previous embodiment, except that it has a wider blade 440 having a preferred width of approximately eight inches and a wider cut-out 500 sized about 3⅝ by 1¾ inches to fit the wider cross member 120.

Figure 6:
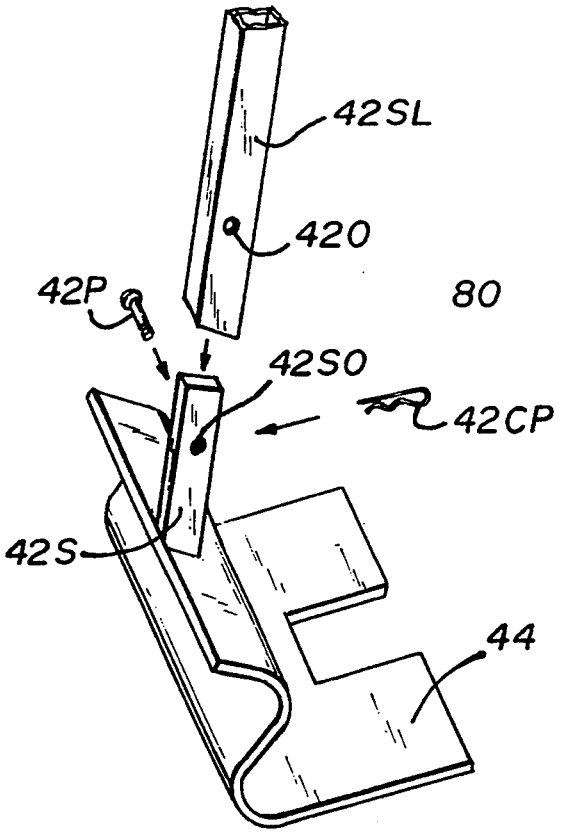
FIG. 6 is an exploded perspective view of a third embodiment of the invention showing the manner of attachment of a removable handle.

Referring to FIG. 6, there is depicted a third embodiment 80 of the invention which is similar to the first embodiment of FIGS. 1–4 but has means for connecting different types of handles. That is, the blade 44 is identical to that of the first embodiment but instead of having a handle 42 welded to it, blade 44 has a stud 42S welded in the same location. This stud 42S can receive handles such as the handle section 42SL shown in FIG. 6. The handle section 42SL includes a sleeve that fits over the stud 42S and each has a hole 42SO and 42O which align with each other when the sleeve section handle 42SL is fitted over the stud 42S. A pin 42P and cotter pin 42CP can then be used to releasably secure the sleeve 42SL and stud 42S together.

Figure 7:
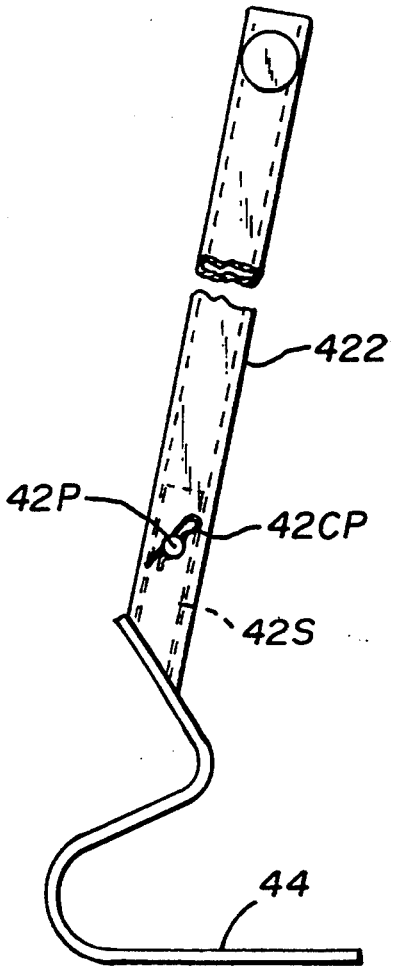
FIG. 7 is a side view of the embodiment of FIG. 6 with another type of removable handle (shown broken and shortened) attached to it.

This arrangement allows handles of various kinds to be placed on the stud 42S in addition to the short straight handle 42SL of FIG. 6, a long T-shaped handle 422 such as shown in FIG. 7 (which is the functional equivalent of the embodiment of FIGS. 1–4).

The handle 42 or 422 may be provided with means such as aligned holes for attaching a right-angle extension handle 433 near their extreme ends.

The offset handle 423 is especially useful in confined areas and with extremely hard to release fasteners. The short handle of FIG. 6 makes a tool that is especially good at removing lightly-held fasteners as in removing picket fencing boards.

Figure 8:
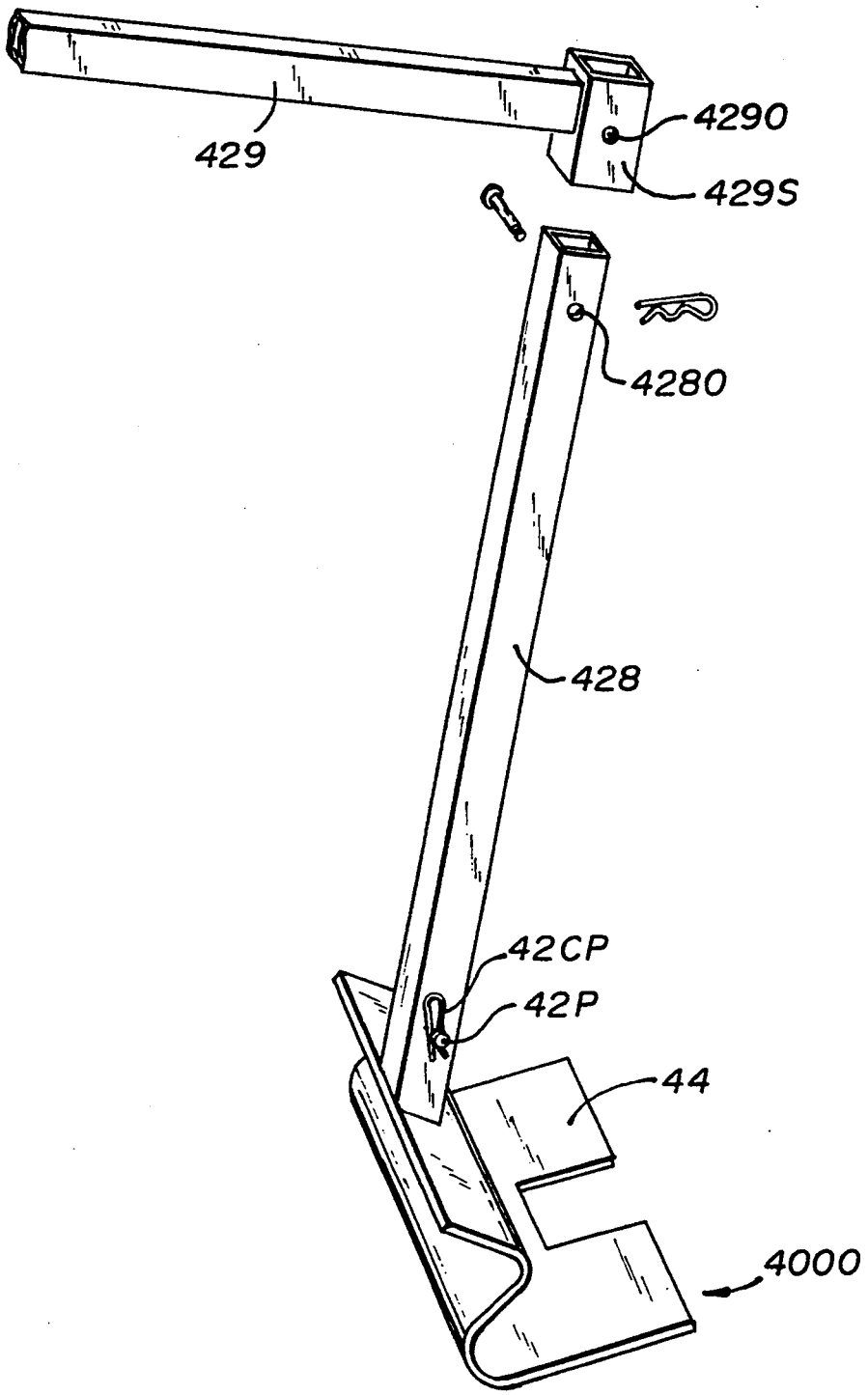
FIG. 8 is a partly exploded perspective view of a third type of handle for the pry blade of FIGS. 6 and 7.

In FIG. 8, another pry shovel 4000 is shown which has a variation of a handle for the blade 44 of FIGS. 6 and 7. In this embodiment, two handle sections 428 and 429 are used. The straight handle section 428 is secured as in the prior two embodiments to the blade 49 using pin 42P and cotter pin 42CP. A right angle extension handle 429 is similarly attached to the end of the handle section 428 using alignable holes 4280 in section 428 and 4290 in a sleeve section 4295 of the handle section 429. This arrangement allows for the use of the pry shovel 4000 in hard to reach locations and allows for the application of a great deal of force on the board to be removed.

A preferred kit would consist of the unit 80, a 16-inch-long handle 422 and a 32-inch-long handle 422' and a 16-inch extension handle 522 which can be attached to either of those handles.

While the pry shovel is of particular usefulness in wooden pallet disassembly, it may also find use in other applications such as wood patio deck board removal and pier dismantling.

While particular embodiments of the invention have been shown and described, it will be obvious to those skilled in the art that changes and modifications may be made without departing from the invention and, therefore, the aim in the appended claims is to cover all such changes and modifications as fall within the true spirit and scope of the invention.

I claim:

1. A pry shovel tool for removing deck boards from a wood pallet or the like wherein the deck boards are fastened to a cross member comprising:

a blade made of stiff but resilient thin spring metal and having upper and lower surfaces and a front edge and rear portion;

a handle for the blade affixed to the blade at said rear portion and wherein:

the blade defines a central cut-out portion from its front edge rearward, which portion is sized to loosely receive the cross member as the blade is advanced around the cross member and under a deck board, the blade further being curved so as to form a fulcrum area for bearing against the deck board adjacent to the deck board to be removed or on the cross member while the upper surface of the front of the blade aside the cut-out portion contacts the underside of the deck board to be removed.

2. The pry shovel of claim 1, wherein:

said blade is less than ¼ inch in thickness and at least twice the width of the cross member.

3. The pry shovel of claim 2, wherein:

said blade is at least 3½ inches in overall width at its front edge and the cut-out portion is about 1¾ inches wide and at least 1½ inch in depth.

4. The pry shovel of claim 3, wherein said blade is at least 7 inches in overall width at its front edge and said cut-out portion is about 3⅝ inches wide and at least 1½ inches deep.

5. The pry shovel of claim 4, wherein said blade is of a uniform thickness over the majority of its area of approximately 3/32 inch.

6. A pry shovel for use with a wooden pallet of the type that has surface boards fastened to cross members of a predetermined width, comprising an elongated handle;

a blade member of flat, thin spring-like material having a rear portion;

means attaching the handle to the rear portion of said blade member;

said blade member having a forward edge with a central cutout therein, which cut-out is slightly wider than said predetermined width of the cross members and is deep enough so as to allow the forward edges of the blade to reach under a fastened surface board of the pallet while the cut-out receives the cross member; and said blade member being shaped into an S-curve between said handle and said cut-out.

7. The pry shovel of claim 6 wherein, when said pry shovel is at rest and not under stress, said forward portion of said blade lies flat in a plane and said handle projects away and forward from that plane at approximately 80 degrees.

8. The pry shovel of claim 1 wherein said handle is releasably secured to the blade and may be changed by substituting handles of different configurations.

9. The pry shovel of claim 8 wherein said handle is affixed to said blade by means of a first member welded to the blade and a conformingly sized and shaped second member on one end of the second handle and means releasably securing the members together.

10. The pry shovel of claim 9 wherein one of said first and second members is a stud and the other defines a cavity sized and shaped to receive said stud.

11. The pry shovel of claim 10 wherein a plurality of different shaped handles are provided, each having a cavity sized and shaped to said stud of said blade, one of said plurality of handles being elongated and having a cross bar at its end away from the blade stud-receiving end and another of said plurality of handles being of a relatively short length.

12. The pry shovel of claim 10 wherein said stud is rectangular in cross section and said cavity is also rectangular in cross section.

13. The pry shovel of claim 12 wherein said stud is welded to said blade, said handle is formed of a length of rectangular cross sectional tubing sized to receive said stud therein.

14. The pry shovel of claim 13 wherein said stud and said handle each have a cotter pin receiving hole and are affixed together by a cotter pin.

15. A pry shovel of claim 6 wherein said handle includes means for allowing the attachment of an auxiliary second handle thereto.

16. The pry shovel of claim 15 including an elongated auxiliary extension second handle attached to said handle at an angle of approximately 90 degrees thereto.

* * * * *